US010715918B2

(12) United States Patent
Miller et al.

(10) Patent No.: US 10,715,918 B2
(45) Date of Patent: Jul. 14, 2020

(54) APPARATUS, SYSTEM, AND METHOD FOR AUDIO AMPLIFIED COMBUSTION

(71) Applicants: Jordan Miller, Littleton, CO (US); Travis Miller, Littleton, CO (US)

(72) Inventors: Jordan Miller, Littleton, CO (US); Travis Miller, Littleton, CO (US)

( * ) Notice: Subject to any disclaimer, the term of this patent is extended or adjusted under 35 U.S.C. 154(b) by 0 days.

(21) Appl. No.: 16/431,311

(22) Filed: Jun. 4, 2019

(65) Prior Publication Data

US 2019/0373374 A1 Dec. 5, 2019

Related U.S. Application Data

(60) Provisional application No. 62/680,357, filed on Jun. 4, 2018.

(51) Int. Cl.

| | |
|---|---|
| ***H04R 9/02*** | (2006.01) |
| ***H04R 1/02*** | (2006.01) |
| ***H04R 7/12*** | (2006.01) |
| ***H04R 9/06*** | (2006.01) |
| ***F23C 15/00*** | (2006.01) |
| ***H04R 3/00*** | (2006.01) |

(52) U.S. Cl.

CPC ..... *H04R 9/022* (2013.01); *F23C 15/00* (2013.01); *H04R 1/025* (2013.01); *H04R 1/028* (2013.01); *H04R 3/00* (2013.01); *H04R 7/12* (2013.01); *H04R 9/06* (2013.01); *H04R 2307/021* (2013.01); *H04R 2307/025* (2013.01); *H04R 2307/029* (2013.01); *H04R 2400/11* (2013.01)

(58) Field of Classification Search

None

See application file for complete search history.

(56) References Cited

U.S. PATENT DOCUMENTS

| | | | | |
|---|---|---|---|---|
| 3,156,292 A * | 11/1964 | Ross | ..... | F23D 14/10 239/419.5 |
| 6,162,045 A * | 12/2000 | Hazard | ..... | F23C 15/00 126/512 |
| 2014/0366950 A1 | 12/2014 | Haskins et al. | | |

OTHER PUBLICATIONS

"Echelon II Direct Vent Gas Fireplace," International Hot Tub Company, 2018, 2 pages [retrieved online from: www.ihtspas.com/product/majestic/echelon-ii-direct-vent-gas-fireplace/].

"Pyroboards We use the most awesome medium to visualize Music: FLAAAMES!!!" Pyroboards, 2014, 3 pages [retrieved online from: web.archive.org/web/20170708211635/http://www.pyroboards.com/].

(Continued)

*Primary Examiner* — Kenny H Truong

(74) *Attorney, Agent, or Firm* — Sheridan Ross P.C.

(57) ABSTRACT

An audio amplified combustion system is described that has a fuel injector a positioned proximate to a speaker so that a flame moves in concert with audio emitted from the speaker. A projection column and projection top can be positioned above the cone of the speaker to define a volume for the combustion. Various apparatuses, methods, and systems for keeping the speaker cool are also described. Coating on various parts of the system to increase or decrease emissivity or absorptivity of various parts can keep the speaker cool. In addition, a control unit can cause the speaker to "pant" or vibrate at a low or high frequency to induce convective and keep the speaker cool. These and other features of the audio amplified combustion system are described herein.

9 Claims, 8 Drawing Sheets

(56) References Cited

OTHER PUBLICATIONS

Nørgaard "The Sound Torch—Set your Music on Fire!" Kickstarter, 2015, 13 pages [retrieved online from: www.kickstarter.com/projects/markusbuchnorgaard/the-sound-torch-set-your-music-on-fire].
Nørgaard "The Sound Torch 2.0," The Sound Torch, 2017, 6 pages [retrieved online from: web.archive.org/web/20171004044614/http://www.thesoundtorch.com/].
Weiner "Ruben's Tube: Who knew sound waves could be so combustible?" Popular Science, Jan. 14, 2009, 6 pages [retrieved online from: www.popsci.com/scitech/article/2009-01/rubens-tube/].

* cited by examiner

APPARATUS, SYSTEM, AND METHOD FOR AUDIO AMPLIFIED COMBUSTION

CROSS-REFERENCE TO RELATED APPLICATIONS

This application claims priority under 35 U.S.C. § 119(e) to U.S. Provisional Patent Application Ser. No. 62/680,357 filed Jun. 4, 2018, which is incorporated herein in its entirety by reference.

FIELD OF THE INVENTION

Embodiments of the present disclosure are related to an apparatus that uses audio or pressure waves to move a flame.

BACKGROUND

Audio amplified combustion systems combine the audio output of a speaker with the visual of a flame to produce a combined audio/visual experience. The speaker can be placed in proximity to the flame so that a pressure wave emitted by the speaker moves the flame. Thus, the flame moves in rhythm with the music from the speaker.

One issue with audio amplified combustion systems is the accumulation of heat on the speaker. The flame is produced by combusting a fuel, and this combustion produces heat. Since the speaker is necessarily in close proximity to the combustion and flame, the speaker is subjected to extreme heat. Physically moving the speaker away from the flame would reduce or completely eliminate the combined audio/visual experience of the audio amplified combustion system. Therefore, there is a need for managing the accumulation of heat on a speaker in an audio amplified combustion system.

SUMMARY

The above shortcomings and other needs are addressed by the various embodiments and configurations of the present disclosure. It is an objective of the present disclosure to provide a system that reduces the heat transferred from a combusting fuel and resulting flame to a speaker.

One aspect of embodiments of the present disclosure is to provide a coating on at least one surface that defines a projection volume that changes the emissivity or absorptivity of that surface. The projection volume is where fuel accumulates before combustion into a flame. Radiation is one mode of heat transfer, and changing the emissivity or absorptivity of certain inner surfaces that define the projection volume reduces the radiation heat transfer to a cone of the speaker. For instance, a coating on the inner surface of a projection top reduces emitted radiation, a coating on the speaker increases reflectivity, and a coating on the inner surface of a projection column increases absorptivity to absorb radiation reflected from the speaker.

Another aspect of embodiments of the present disclosure is to provide an insulation material on the speaker to keep the speaker cool. Conduction is another mode of heat transfer, and a gasket can connect the top of the speaker chassis to the bottom of the projection column to prevent, or at least slow, the transfer of heat from the projection column to the speaker via conduction. The thermal conductivity of the gasket material is less than the thermal conductivity of the projection column.

A further aspect of embodiments of the present disclosure is to provide an active cooling system around the projection volume to remove heat via convection, another mode of heat transfer. A vent column can surround a portion of the projection column and speaker to define a vent volume around the projection column and speaker. One or more openings can be located at a top end of the vent column, and one or more openings can be located at a bottom end of the vent column. An air handler such as a fan can move air from one set of openings to the other set of openings to move air across the outer surface of the projection column and speaker and reduce the temperature of the projection column and speaker.

Yet another aspect of embodiments of the present disclosure is to provide a control unit that can cause the speaker to produce a pressure wave in order to move air within the projection volume and convectively cool the speaker. The control unit provides function such as receiving an audio input, converting the audio input to a frequency domain, and then subsequently controlling the speaker and the fuel injector to produce sound and a varying flame to create a combination of music and moving flame. However, when the audio input does not result in the cone of the speaker moving or there is no audio input at all, a still-lit flame or pilot light can increase the temperature of the speaker, causing damage. Based on one or more conditions, the speaker can produce an audible or inaudible pressure wave to move air within the projection column to induce convective cooling and keep the speaker cool. For example, after 60 seconds of inactivity, the control unit can cause the speaker to produce a pressure wave of less than 20 Hz and/or greater than 20 kHz to move air within the projection column. It will be appreciated that other conditions such as a threshold temperature can be used in addition to, or in alternative to, the time period of inactivity. In addition, the inactivity period can be 30 seconds, 90 seconds, etc.

One particular embodiment of the present disclosure is an audio amplified combustion system, comprising a speaker having a cone that moves relative to a chassis to produce a pressure wave, the cone comprising a material that has a cone absorptivity; a projection column extending away from the cone of the speaker, the projection column comprising a material with a column absorptivity, wherein the projection column has an opening at a distal end of the projection column; a projection top positioned over the opening of the projection column, the projection top having at least one escape aperture through the projection top, and the projection top comprising a material with a top emissivity, wherein the cone, an inner surface of the projection column, and an inner surface of the projection top define a projection volume; and a first coating on the cone that reduces absorptivity to less than the cone absorptivity.

In various embodiments, the system further comprises a second coating on the inner surface of the projection column that increases absorptivity to greater than the column absorptivity. In some embodiments, the system further comprises a third coating on the inner surface of the projection top that reduces emissivity to less than the top emissivity. In some embodiments, the material that the cone comprises is at least one of a paper and a Kevlar, the material that the projection column comprises is at least one of 302 stainless steel or 304 stainless steel, and the material that the projection top comprises is at least one of 302 stainless steel or 304 stainless steel.

In various embodiments, the projection top has a top surface area, and the at least one escape aperture has an escape area within the top surface area, wherein the escape area is between approximately 0.6% and 1.4% of the top surface area to reduce leading amplified burnout. In some embodiments, the at least one escape aperture comprises a first plurality of escape apertures arranged in a circle about a center of the projection top and a second plurality of escape apertures arranged in a circle about the center of the projection top, wherein the first and second pluralities of escape apertures are concentrically arranged with an offset that is between approximately 0.2 inches and 1 inch.

In various embodiments, the system further comprises a gasket connected to the speaker and connected to the projection column, wherein a thermal conductivity of the gasket is less than a thermal conductivity of the projection column, and an inner surface of the gasket at least partially defines the projection volume. In some embodiments, the system further comprises a vent column arranged around at least a portion of the projection column and the speaker to define a vent volume, wherein the vent column extends away from the chassis of the speaker and has an opening at a distal end; and a fan positioned in the opening at the distal end of the vent column, wherein the fan moves air within the vent volume and induces convective cooling and on the projection column and the speaker. In various embodiments, the system further comprises a fuel injector operably connected to the projection volume, wherein the fuel injector dispenses fuel within the projection volume; and an ignition source that ignites fuel emitted from the projection volume.

Another particular embodiment of the present disclosure is an audio amplified combustion system, comprising a speaker having a cone that moves relative to a chassis to produce a pressure wave; a projection column extending away from the cone of the speaker, wherein the projection column has an opening at a distal end of the projection column; a fuel injector operably connected to the projection volume, wherein the fuel injector dispenses fuel within the projection volume; a projection top positioned over the opening of the projection column, wherein the cone, an inner surface of the projection column, and an inner surface of the projection top define a projection volume; at least one escape aperture through the projection top to emit fuel from the projection volume, the at least one escape aperture having an escape area that is between approximately 0.6% and 1.4% of a top surface area of the projection top, and a ratio between the projection volume and the escape area is greater than 250 inches.

In some embodiments, the cone comprises a material that has a cone absorptivity, and the projection column comprises a material with a column absorptivity, and the projection top comprises a material with a top emissivity, wherein a first coating on the cone reduces absorptivity to less than the cone absorptivity, a second coating on the inner surface of the projection column increases absorptivity to greater than the column absorptivity, and a third coating on the inner surface of the projection top reduces emissivity to less than the top emissivity. In various embodiments, the system further comprises a gasket connected to the speaker and connected to the projection column, wherein a thermal conductivity of the gasket is less than a thermal conductivity of the projection column, and an inner surface of the gasket at least partially defines the projection volume.

In various embodiments, the system further comprises a vent column arranged around at least a portion of the projection column and the speaker to define a vent volume, wherein the vent column extends away from the chassis of the speaker and has an opening at a distal end; and a fan positioned in the opening at the distal end of the vent column, wherein the fan moves air within the vent volume and induces convective cooling on the projection column and the speaker. In some embodiments, the system further comprises a fuel injector operably connected to the projection volume, wherein the fuel injector dispenses fuel within the projection volume; and an ignition source that ignites fuel emitted from the projection volume.

Yet another particular embodiment of the present disclosure is an audio amplified combustion system, comprising a speaker having a cone that moves relative to a chassis to produce a pressure wave; a projection column extending away from the cone of the speaker, wherein the projection column has an opening at a distal end of the projection column; a fuel injector operably connected to the projection volume, wherein the fuel injector dispenses fuel within the projection volume; a projection top positioned over the opening of the projection column, wherein the cone, an inner surface of the projection column, and an inner surface of the projection top define a projection volume; a control unit operably connected to the fuel injector and the speaker to control fuel dispensing and the pressure wave; instructions that, when executed by the control unit, cause the control unit to: determine an inactivity period for the speaker; cause the speaker to produce a series of pressure waves to move air within the projection volume to induce convective cooling of the speaker.

In some embodiments, the system further comprises instructions that, when executed by the control unit, cause the control unit to determine a frequency range of the audio input; amplify the frequency range by a predetermined value; cause the fuel injector to dispense increased fuel. In various embodiments, the cone comprises a material that has a cone absorptivity, and the projection column comprises a material with a column absorptivity, and the projection top comprises a material with a top emissivity, wherein a first coating on the cone reduces absorptivity to less than the cone absorptivity, a second coating on the inner surface of the projection column increases absorptivity to greater than the column absorptivity, and a third coating on the inner surface of the projection top reduces emissivity to less than the top emissivity.

In some embodiments, the predetermined period is at least 60 seconds, and the second series of pressure waves comprises frequencies that are at least one of less than 20 Hz or greater than 20 kHz. In various embodiments, the projection top has a top surface area, and the at least one escape aperture has an escape area in the top surface area, wherein the escape area is between approximately 0.6% and 1.4% of the top surface area to reduce leading amplified burnout. In some embodiments, a ratio between the projection volume and the escape area is greater than 250 inches.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary, brief description of the drawings, detailed description, abstract, and claims themselves.

BRIEF DESCRIPTION OF THE DRAWINGS

The accompanying drawings, which are incorporated in and constitute a part of the specification, illustrate embodiments of the disclosure and together with the Summary of the Invention given above and the Detailed Description of the drawings given below, serve to explain the principles of these embodiments. In certain instances, details that are not necessary for an understanding of the disclosure or that render other details difficult to perceive may have been omitted. It should be understood, of course, that the disclosure is not necessarily limited to the particular embodiments illustrated herein. Additionally, it should be understood that the drawings are not necessarily to scale.

Figure 1:
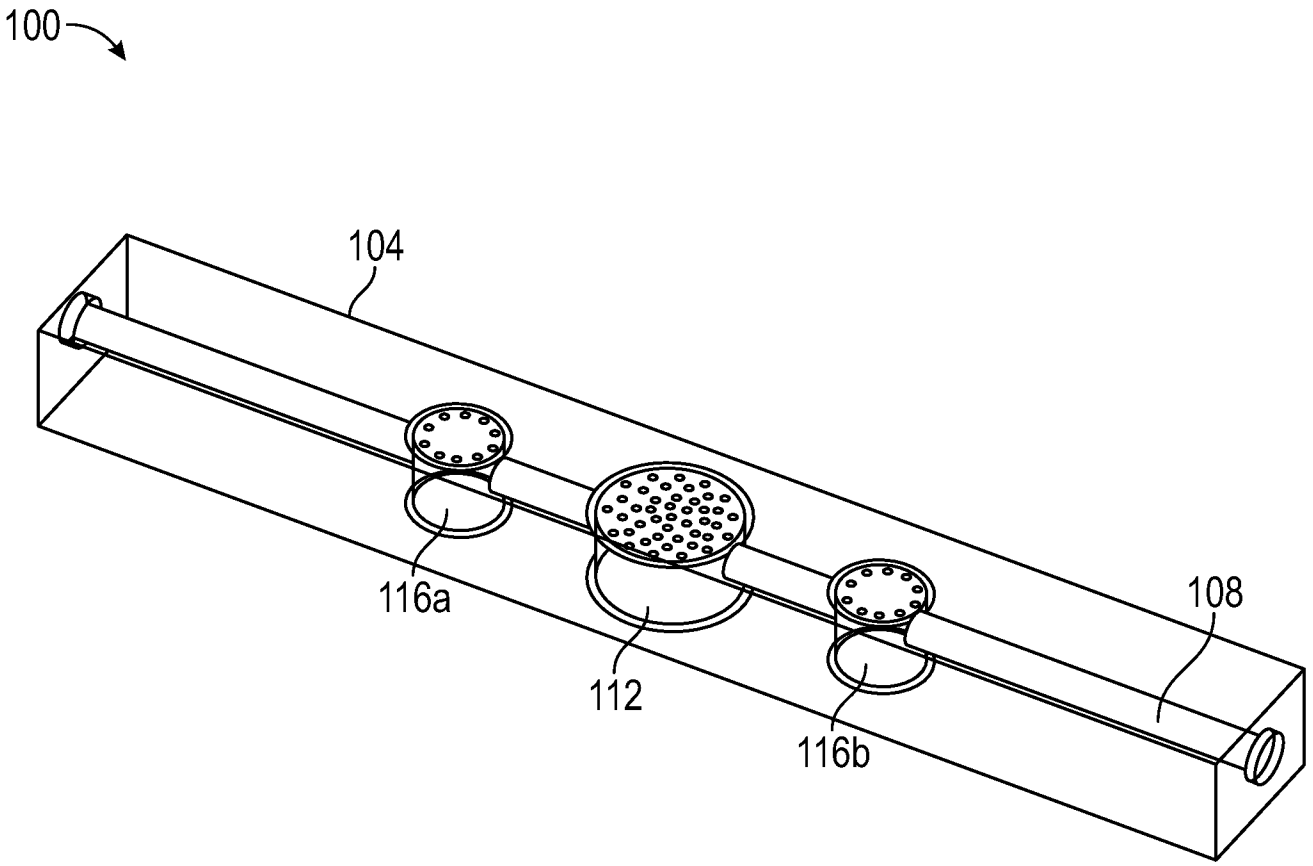
FIG. 1 is a perspective view of an audio amplified combustion system in accordance with one embodiment of the present disclosure.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 100 | System |
| 104 | Housing |
| 108 | Projection Row |
| 112 | First Projection Column |
| 116 | Second Projection Column |
| 120 | Column Inner Surface |
| 122 | Projection Volume |
| 124 | Fuel Opening |
| 128 | Fuel Injector |
| 132 | Speaker |
| 136 | Cone |
| 140 | Chassis |
| 144 | Gasket |
| 148 | Base |
| 152 | Projection Top |
| 156 | Escape Aperture |
| 160 | Top Inner Surface |
| 164 | Vented Column |
| 166 | Vent Volume |
| 168 | Fuel Opening |
| 172 | Vent Opening |
| 176 | Distal Opening |
| 180 | Air Handler |
| 184 | Cone Inner Surface |
| 188 | Top Surface Area |
| 192 | Row Pitch |
| 196 | Aperture Offset |
| 200 | Control Unit |
| 204 | Fuel Injector |
| 208 | Speaker |
| 212 | Electronic Device |
| 216 | Receive |
| 220 | Convert |
| 224 | Determine |
| 228 | Amplify |
| 232 | Transmit |
| 236 | Receive |
| 240 | Determine |
| 244 | Transmit |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present disclosure are described herein and as depicted in the drawings. It is expressly understood that although the figures depict audio amplified combustion system, and methods for using the same, the present disclosure is not limited to these embodiments.

Figure 2:
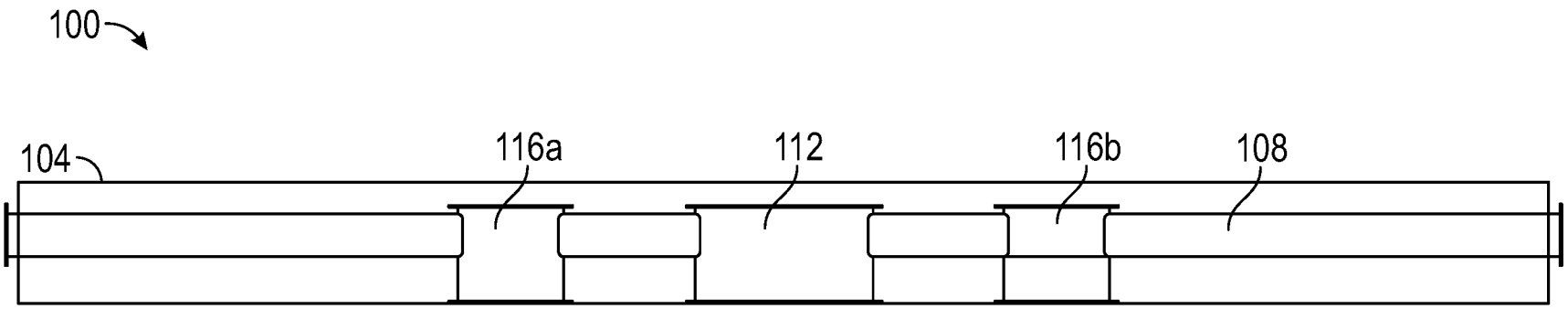
FIG. 2 is an elevation view of an audio amplified combustion system in accordance with one embodiment of the present disclosure.

Now referring to FIGS. 1 and 2, a perspective view and an elevation view of an audio amplified combustion system 100 are provided, respectively. The system 100 generally has a housing 104 that at least partially encloses a projection row 108, a first projection column 112, and second projection columns 116*a*, 116*b*. The projection row 108 can house a fuel line or otherwise direct fuel to the columns 112, 116*a*, 116*b*, which are oriented perpendicular to the projection row 108. In addition, the projection row 108 can have one or more escape apertures to emit fuel into a flame and contribute to the combined audio/visual experience. On a top surface of the housing 104, the columns 112, 116*a*, 116*b* each emit a flame that varies in size and/or intensity in concert with audio emitted from speakers in the columns 112, 116*a*, 116*b*. The result is an aesthetically pleasing visual and audio experience.

Figure 3:
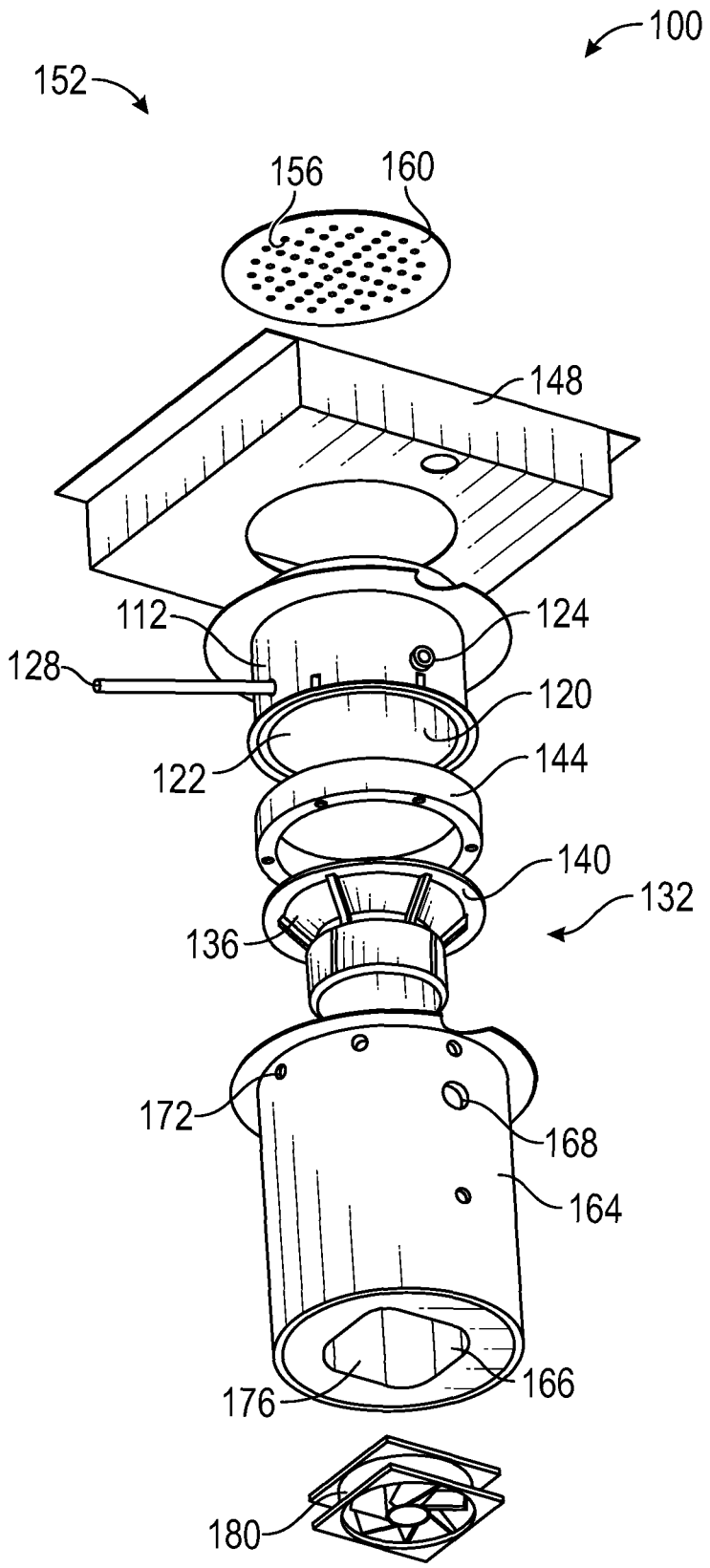
FIG. 3 is a bottom, exploded perspective view of a speaker and projection column of an audio amplified combustion system in accordance with one embodiment of the present disclosure.

Now referring to FIG. 3 is a bottom perspective view of a projection column 112 and other components of an audio amplified combustion system 100 is provided. In this embodiment, the projection column 112 has a cylinder shape with open ends and an inner surface 120, however, it will be appreciated that other embodiments can have other shapes. A fuel opening 124 in a side surface of the projection column 112 permits a first fuel source to access the projection volume 122 at least partially defined by the inner surface 120 of the projection column 112. This first fuel source provides a constant or baseline amount of fuel to the projection volume 122 and the flame above the projection volume 122. A fuel injector 128 provides a second fuel source to the projection volume 122 that is variable with a converted audio input, which results in the varying flame above the projection volume 122.

Next, a speaker 132 is positioned at a bottom end of the projection column 112 and projection volume 122. The speaker 132 can be any device that produces a mechanical and/or pressure wave. In the depicted embodiment, the speaker 132 is an electromagnetically driven speaker where a varying input to an electromagnetic coil modulates a permanent magnet on a cone 136 relative to a chassis 140 to produce a pressure wave. The speaker 132 emits sound out of the top of the projection volume 122 to provide the audio component of the system 100. A gasket 144 can be positioned between the projection column 112 and the speaker 132 to limit heat conduction to the speaker 132. In an exemplary embodiment, the gasket 144 is a combination of two silicon, high-temperature gaskets adhered together by a high-temperature silicon sealant.

A top end of the projection column 112 is connected to a base 148 in this embodiment, and a projection top 152 is positioned at the top end of the projection column 112. The projection top 152 has a plurality of escape apertures 156 that allow fuel to move out of the projection volume 122 to the air above the projection top 152 where the fuel is combusted and produces a flame. As shown, an inner surface 160 of the projection top 152 at least partially defines the projection volume 122. As described in further detail below, the configuration of the projection top 152 prevents burnout of the flame.

An active cooling system can cool the outer surfaces of the projection column 112 and the speaker 132. A vent column 164 is connected at an upper end of the projection column 112, and the vent column 164 defines a vent volume 166 around the projection column 112, around the speaker 132, and below the speaker 132. A fuel opening 168 in the vent column 164 allows a first fuel source to supply the projection volume 122 with a constant supply of fuel. One or more vent openings 172 at a top end of the vent column 164 provides access to the vent volume 166, and a distal opening 176 at a bottom end of the vent column 164 also provides access to the vent volume 166. An air handler 180, in this instance a fan, moves air into the vent volume 166 from the ambient environment and out of the vent openings 172. Alternatively, the air handler 180 draws air into the vent volume 166 from the vent openings 172 and out of the distal opening 180. Fin structures within the vent volume 166, for example extending from the projection column 112, provide an increased surface area to remove heat and enhance the active cooling system.

Figure 4:
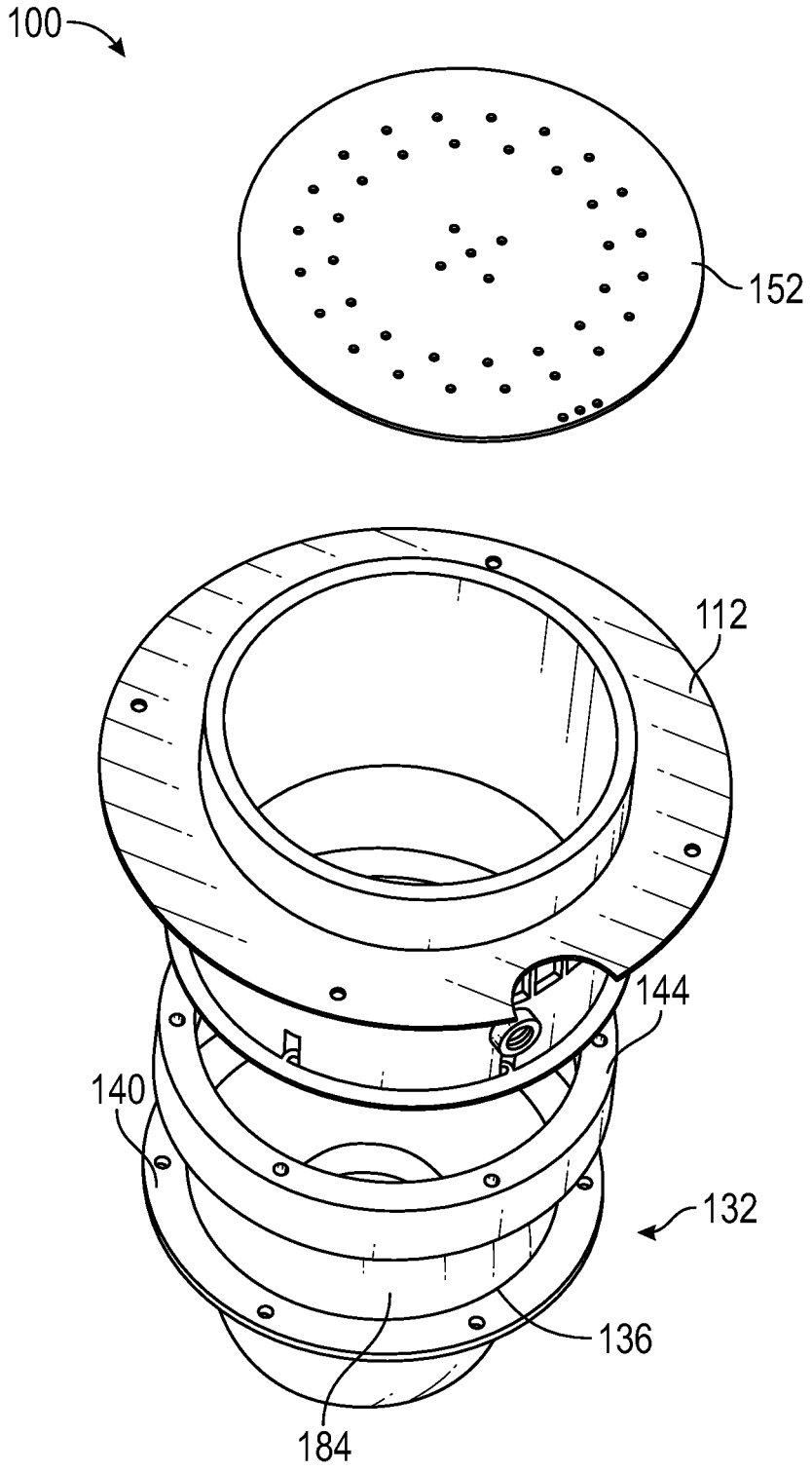
FIG. 4 is a top, exploded perspective view of a speaker and projection column of an audio amplified combustion system in accordance with one embodiment of the present disclosure.
Figure 5:
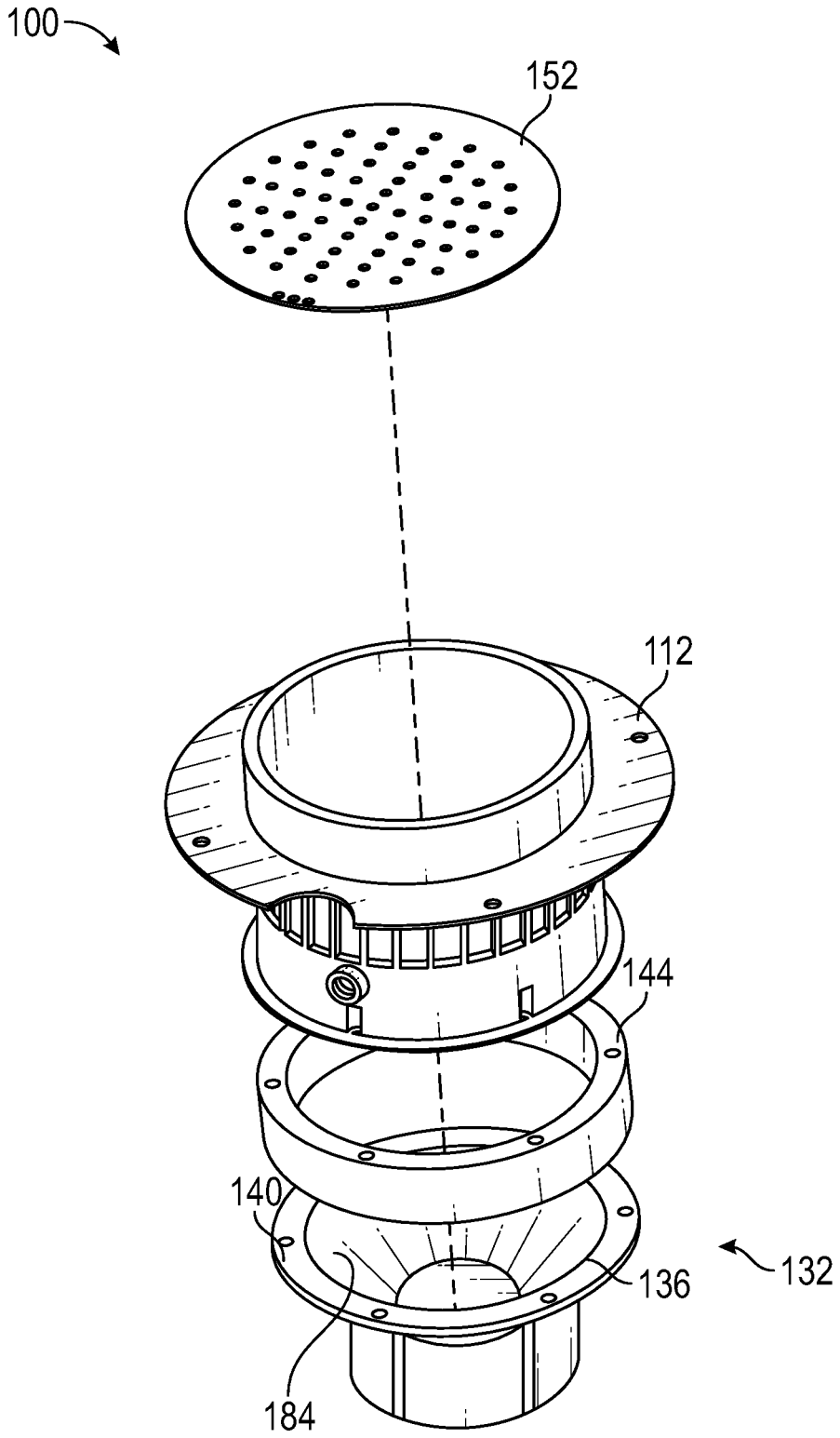
FIG. 5 is a further top, exploded perspective view of a speaker and projection column of an audio amplified combustion system in accordance with one embodiment of the present disclosure.

Now referring to FIGS. 4 and 5, further perspective views of the projection column 112 and the speaker 132 are provided. An inner surface 184 of the cone 136 is shown, and the inner surfaces of the projection column 112, the projection top 152, and the cone 136 can optionally include enhanced surfaces to manage the heat within the projection volume as the flame is combusted above the projection top 152. A coating on the inner surface of the projection top 152 can reduce the emissivity of the material of the projection top 152 to reduce the radiation emitted from the inner surface, a coating on the cone of the speaker 132 can increase reflectivity of the material of the cone to reflect radiation away, and a coating on the inner surface of the projection column 112 can increase absorption of the material of the projection column to absorb heat reflected from the cone. Stated differently, the coatings on the projection top 153 and the cone of the speaker 132 decrease emissivity and absorptivity of the respective materials whereas the coating on the projection column 112 increases absorptivity of the respective material. This configuration manages the heat produced by the combusting fuel and the resulting flame.

Figure 6:
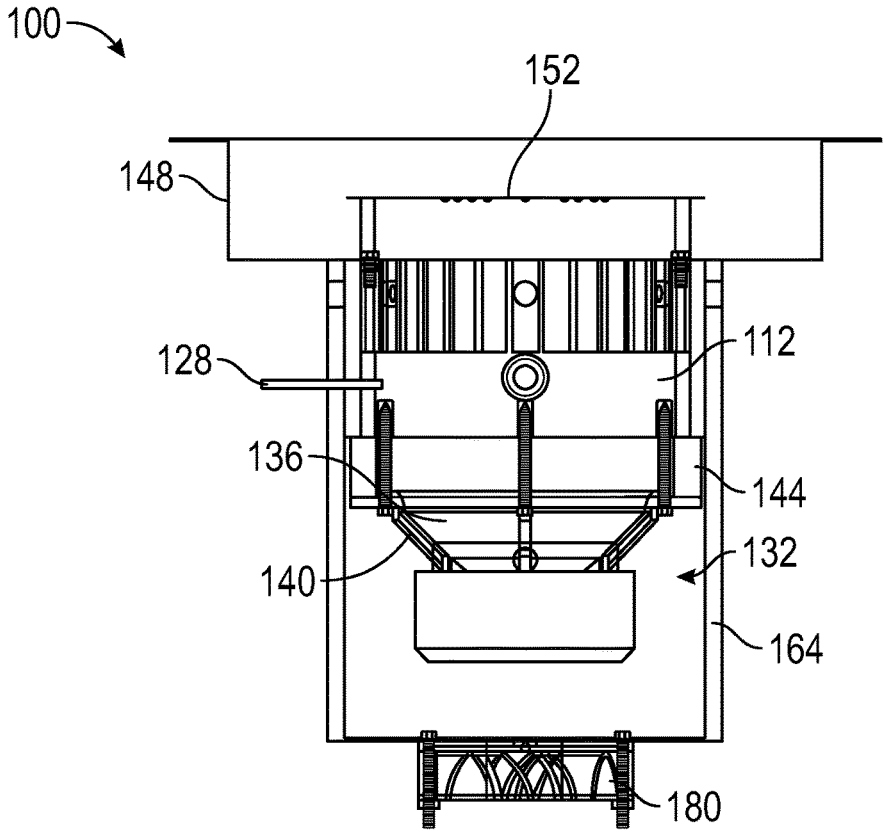
FIG. 6 is an elevation view of a speaker and projection column of an audio amplified combustion system in accordance with one embodiment of the present disclosure.

Now referring to FIG. 6, a side elevation view of the projection column 112 and surrounding components is provided. The projection column 112 and the surrounding components are assembled in this figure. It will be appreciated that a pilot light can be positioned in or around the projection volume to keep at least a small flame ignited.

Figure 7:
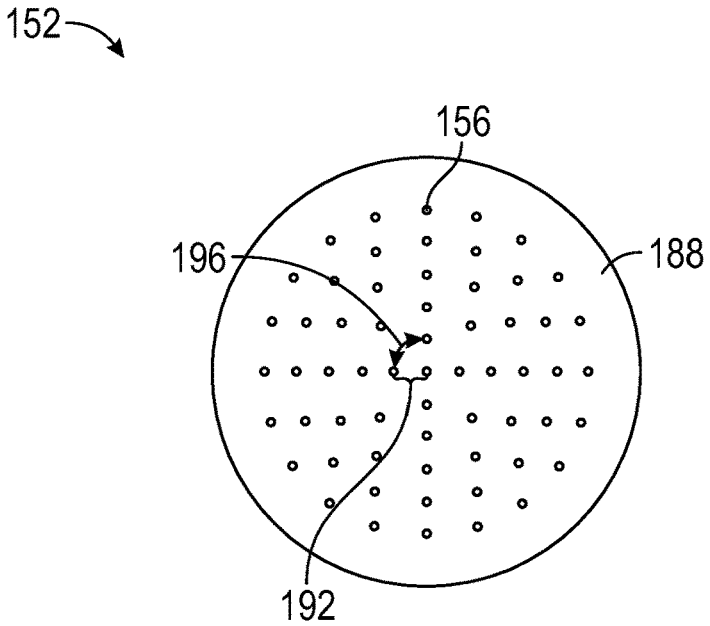
FIG. 7 is a top plan view of a projection top of an audio amplified combustion system in accordance with one embodiment of the present disclosure.

Now referring to FIG. 7, a top plan view of the projection top 152 is provided. As discussed above, the projection top 152 has a plurality of escape apertures 156 to allow fuel out of the projection volume and into a flame for combustion. The escape apertures 156 are configured to prevent the flame on the projection top 152 from burning out, which results in uncombusted fuel emitting from the projection volume.

One type of burnout is leading amplified burnout. This occurs when the total escape area of the projection top 152 is too small, the separation between escape apertures 156 is too large, the speaker drive is too high, or a combination of all the factors. This burnout is characterized by a flame that is extinguished almost immediately after a turbulent propulsion or strong displacement by the speaker. This is because the flames formed on top of the projection top are very small due to the small escape aperture area and/or large spacing between escape apertures 156. Flames that are far apart have more differentiation and less flame fusing, and these flames are more vulnerable to being extinguished and much less likely to re-ignite quickly. To combat this type of burnout, the total area of the escape apertures 156 compared to the top surface area 188 of the projection top 152 is between approximately 0.6% and 1.4% in some embodiments. In various embodiments, the total area of the escape apertures 156 is approximately 1% of the top surface area 188. It will be appreciated that the term "approximately" can mean a less than 10% relative difference in some embodiments.

In addition, FIG. 7 shows different types of spacing between individual escape apertures 156. In this embodiment, the escape apertures 156 are arranged in concentric circle patterns arranged about a center of the projection top 152. A circle-to-circle spacing 192 can be between approximately 0.2 inches and 1 inch in some embodiments. In various embodiments, the circle-to-circle spacing 192 is approximately 0.5 inches. Next, the escape apertures 156 can have an offset 196 between escape apertures 156 along each concentric circle. In some embodiments, the offset 196 can be between approximately 0.2 inches and 1 inch in some embodiments. In various embodiments, the offset 196 is approximately 0.5 inches.

The second type of burnout is continuous amplified burnout. This is burnout that occurs over a prolonged series of subsequent turbulent propulsions or one turbulent propulsion extending for a prolonged period of time. The original turbulent propulsion would not necessarily induce amplified burnout, but as more turbulent propulsions occur the flame height continually decreases until there is nothing left and the flame is extinguished. This is an issue if the volume of the projection column is too small, the total escape area is too large, the internal speaker drive is too high, or a combination of all factors. As turbulent propulsions persist, the amount of fuel is eventually depleted because there is too much total escape area, the volume of the projection column is too small, or increased speaker drive is forces out too much fuel. Therefore, to prevent this issue, the ratio of volume of projection column divided by total escape area is greater than 250 inches in some embodiments. In various embodiments, the ratio is greater than 300 inches.

Figure 8:
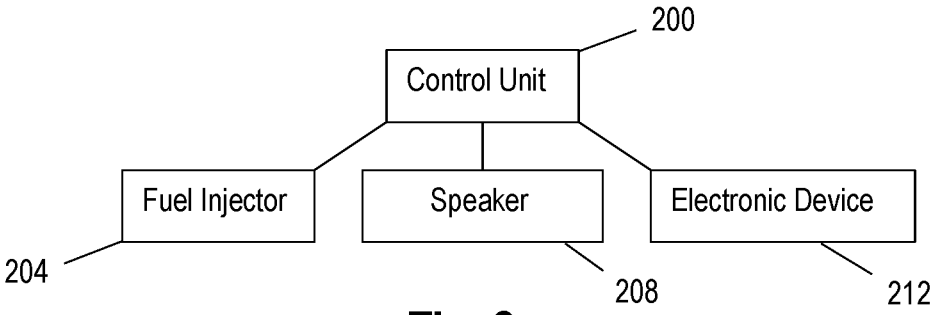
FIG. 8 is a schematic diagram of a control unit of an audio amplified combustion system in accordance with one embodiment of the present disclosure.

Now referring to FIG. 8, a schematic diagram of components of the audio amplified combustion system is provided. A control unit 200 can be operably connected to a fuel injector 204, a speaker 208, and an electronic device 212. In some embodiments, the control unit 200 and the electronic device 212 may be combined into a single unit or device. Generally, the control unit 200 can receive an audio input and transmit the audio input to the electronic device 212. Then, the electronic device 212 converts the audio input from a time domain to a frequency domain, and the electronic device 212 transmits the converted audio input to the control unit 200. Next, the control unit 200 can transmit the converted audio input to the fuel injector 204 to dispense more or less fuel into the projection volume in concert with the audio input sent from the control unit 200 to the speaker 208. It will be appreciated that practical applications of the combustion system can include, for example, a time delay between the signal to the speaker 208 and the signal to the fuel injector 204 to account for differences in the speed of sound and the time for additional fuel to reach the flame above the projection column and combust.

Figure 9:
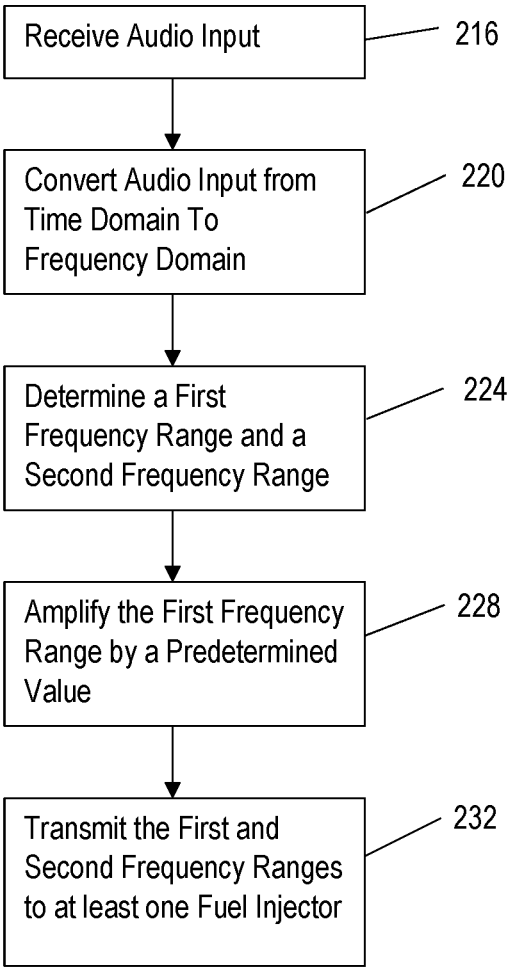
FIG. 9 is a sequence for processing an audio input of an audio amplified combustion system in accordance with one embodiment of the present disclosure.

Now referring to FIG. 9, an exemplary sequence for processing the audio input is provided. In terms of increasing or decreasing the amount of fuel that reaches the flame in response to a converted audio input, the flame may not always match the audio in an aesthetically pleasing manner. In other words, not all types of music cause the flame to react in a meaningful way. Frequencies associated with piano, guitar or soprano voices (found in classical, folk or contemporary music, for example) do not cause the flame to move as much as bass frequencies. In order to make the flame react to all types of music, it can be necessary to selectively amplify some frequencies. This amplification can be done by taking the audio input and amplifying desired frequencies before providing the frequency converted audio input to the fuel injector.

Important considerations for amplifying desired frequencies are use with any type of music as input, real-time operation as fast as the music changes, spectral analysis to isolate key frequencies, and provide those key frequencies to the fuel injector without affecting the external audio sound that the listener hears. Referring to the example in FIG. 9, the control unit can receive 216 and convert 220 the audio input to the frequency domain. Then, the control unit can determine 224 at least two sets of frequencies, and the control unit modifies 228 at least one of the sets of frequencies to either increase or decrease the amount of fuel that a fuel injector will dispense. Then the sets of frequencies are transmitted 232 to the fuel injector. It will be appreciated that a given projection column can have multiple fuel injectors where each fuel injector corresponds to a set of frequencies. Thus, a modified frequency set can be transmitted to one fuel injector and an unmodified, or modified, frequency set can be transmitted to another fuel injector. In further embodiments, different projection columns can have one or more fuel injectors, and each projection column receives a different frequency set.

Figure 10:
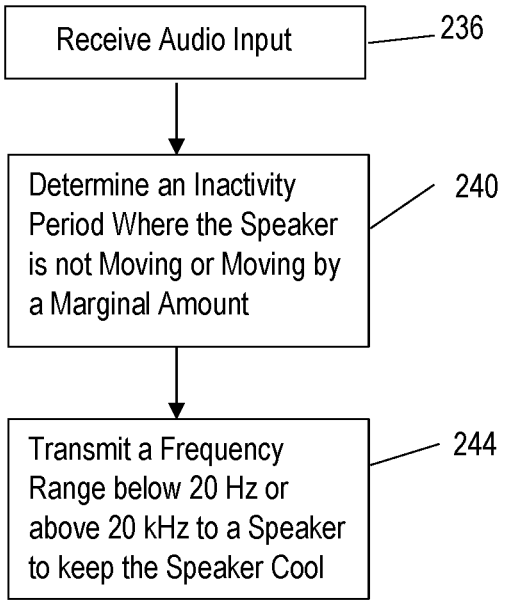
FIG. 10 is a sequence for causing a speaker to move air and cool down in accordance with one embodiment of the present disclosure.

Now referring to FIG. 10, a sequence for causing an inactive speaker to move air in the projection volume to induce convective cooling of the speaker is provided. When a speaker is inactive or marginally active, a baseline flame or pilot light at the projection top can cause the temperature of the speaker to rise over time. Therefore, the speaker can "pant" or cause air to move within the projection volume to cool the speaker. Testing shows that speaker "panting" could slow the heating rate of the cone of the speaker by over 20%.

One or more conditions can cause the speaker to "pant" or move. For example, a period of inactivity of 60 seconds can cause the speaker to move. However, it will be appreciated that any period of time can be used to cause the speaker to move. In addition, a threshold temperature can be added as a condition. For example, the speaker must be inactive for a predetermined period and exceed a threshold temperature for the speaker to move. The threshold temperature can be greater than 120° F. in some embodiments. The resulting movement can also vary in different embodiments. The speaker can vibrate at frequencies less than 20 Hz and/or greater than 20 kHz to be inaudible to a human. In further embodiments, the speaker can vibrate at any frequency range. Therefore, with respect to FIG. 10, a control unit can receive 236 an audio input. Then, the control unit can determine 240 the necessary condition such as an inactivity period, and the control unit can cause 244 the speaker to move or vibrate at a predetermined frequency.

Now experimental results related to the above disclosure are discussed in further detail. Early testing identified a major reliability concern with the burner column/speaker assembly that was identified to be thermal radiation. As objects heat up, they emit energy in the form of radiation. The hotter the object, the greater the intensity, and thus, the greater thermal energy is radiated from the object. In addition, the emissivity of an object is its effectiveness at emitting thermal energy. As described above, to get rid of the excess heat before it damages the speaker, special coatings are placed over the speaker, on the underside of the projection top, and on the inside of the projection column. A reflective coating that does not absorb radiation is placed on the speaker to reflect as much energy as possible. An absorptive coating is placed on the inside of the projection column to absorb the reflected energy from the speaker. Finally, a coating is placed on the bottom of the projection top to reduce the emissivity of the steel and cause less energy to be radiated toward the speaker. These three coatings, or combinations thereof, are used in the burner column/speaker assembly to mitigate the damage caused by thermal radiation.

During initial observation of the audio amplified gas combustion effect, four speakers of three different types were destroyed. A failure analysis showed that all three different types of speakers failed, or were damaged by, heat that they were not capable of withstanding. Damage of all three occurred between the connection of the cone to the spider (bonds the cone to the coil that controls the movement), or the cone to the surround of the speaker (bonds the cone to frame/mounting). The composition of the cones ranged from paper/Kevlar up to glass-fiber/aluminum composites. Effort was focused on the cone to determine if there was a way to avoid damage. Temperatures were taken of the cone during operation of the fireplace to see how hot the cone was getting before damage occurred, and it was found that after two minutes, the cones of the speakers were reaching temperatures as high as 200° F. Calculations were performed to determine just how much heat the projection top was emitting. The emissivity of stainless steel is ~0.4 (0.36-0.44). The projection tops reach temperatures of ~700-750° F. Assuming the steel acts as a gray body with an emissivity coefficient of 0.4, 4626 W/m2 are emitted. Two columns are used, one with a diameter of 3.5" and one with a diameter of 6". For the column with the larger diameter, this means ~84 watts of thermal energy are being emitted into the column chamber. For the smaller diameter column, this equates to ~18 watts of thermal energy. It has been observed that columns with the smaller diameter do not suffer nearly the thermal damage that the larger diameter columns do.

Many different types of paints were tested to find high temperature, flame proof paints that could alter the absorption/reflection characteristics of the steel and speakers. Each of them were tested for five minutes on a stainless steel type 304 plate created for testing purposes and mounted underneath the columns where the speakers would be placed. First, a plain, uncoated plate was used as a control to determine the baseline temperature. The control rose to a temperature of 92° F. after five minutes. Nine coatings were added to the steel plates, and the results show some paints being less absorptive than others. The lowest temperature recorded after five minutes was 106° F., and the highest temperature was 205° F. Even though the most reflective coating still absorbed more heat than the plain stainless steel, it still performed significantly better than the paper/Kevlar speaker cone. The table below shows the different coatings as well as their starting and ending temperatures during testing.

TABLE 1

Coating Tests

| Coating Number | Start Temperature (° F.) | Ending Temperature (° F. after 5 minutes) |
|---|---|---|
| Paper Cone Speaker | 61 | 190* |
| Stainless Steel (No Coat) | 64 | 92 |
| 1 | 70 | 110 |
| 2 | 67 | 198 |
| 3 | 62 | 196 |
| 4 | 72 | 205 |
| 5 | 69 | 106 |
| 6 | 71 | 204 |
| 7 | 70 | 179 |
| 8 | 65 | 188 |
| 9 | 64 | 167 |

*Test was stopped at 3 minutes to avoid damage

As can be seen above, many of these coatings performed similarly. Coatings 2, 3, 4, and 6, all had similar absorption properties and ended up around the same temperature. Due to the most confidence of coating 4 to last in a flame environment, it was selected to be placed around the inside of the column walls to absorb as much energy as possible to keep it away from the speaker.

The next piece of the solution is to identify a coating that would reflect energy from the speaker. A low emissivity, highly reflective coating was found that had similar properties to aluminum, but could withstand the heat, would not warp, and could be applied like a paint to any surface. To determine if this coating would work, a thin aluminum sheet was placed on top of the stainless steel plates, above the coatings tested in the above table. Coating 9 was used to determine the efficacy of the aluminum sheet. The results of the test can be seen in Table 2.

TABLE 2

Effectivity of Aluminum sheet

| Coating | Starting Temperature (° F.) | Ending Temperature (° F. after 5 minutes) |
|---|---|---|
| 9 | 64 | 167 |
| 9 With Aluminum Sheet | 68 | 100 |

As can be seen above, the aluminum sheet reflected most of the energy that would have otherwise been absorbed by the steel plate.

The final coating to be identified and used in the column/speaker assembly was a coating to go on the underside of the projection top to reduce the emissivity, and thus the radiated thermal energy, entering the chamber. As stated above, stainless steel type 304 has an emissivity of ~0.4, and so radiates roughly 40% of the energy a black body would. A coating was identified that, when applied to stainless steel type 304, reduces the emissivity from 0.4 to ~0.24. A reduction of the overall heat entering the chamber due to radiation by 40% means only ~50 watts of thermal energy instead of ~84 watts.

When all three of these coatings are used together, the speakers mounted underneath the columns are estimated to increase in temperature at a rate as low as 25% that of the speaker without any coatings at all. Because of a slower rate of temperature increase, a lower steady state temperature also occurs. This means that after the burners have been operating for a long period of time, the speakers will still be within their rated specifications, and radiated energy will not cause damage to the speakers. It will be appreciated that the experimental results are in no way limiting to the materials and configurations tested, but simply demonstrate the efficacy and benefits of embodiments described herein.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

The term "automatic" and variations thereof refer to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

The term "computer-readable medium" refers to any computer-readable storage and/or transmission medium that participate in providing instructions to a processor for execution. Such a computer-readable medium can be tangible, non-transitory, and non-transient and take many forms, including but not limited to, non-volatile media, volatile media, and transmission media and includes without limitation random access memory ("RAM"), read only memory ("ROM"), and the like. Non-volatile media includes, for example, NVRAM, or magnetic or optical disks. Volatile media includes dynamic memory, such as main memory. Common forms of computer-readable media include, for example, a floppy disk (including without limitation a Bernoulli cartridge, ZIP drive, and JAZ drive), a flexible disk, hard disk, magnetic tape or cassettes, or any other magnetic medium, magneto-optical medium, a digital video disk (such as CD-ROM), any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored. Computer-readable storage medium commonly excludes transient storage media, particularly electrical, magnetic, electromagnetic, optical, magneto-optical signals.

A "computer readable storage medium" may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may be any computer readable medium that is not a computer readable storage medium and that can communicate, propagate, or transport a program for use by or in connection with an instruction execution system, apparatus, or device. A computer readable signal medium may convey a propagated data signal with computer readable program code embodied therein, for example, in baseband or as part of a carrier wave. Such a propagated signal may take any of a variety of forms, including, but not limited to, electromagnetic, optical, or any suitable combination thereof. Program code embodied on a computer readable signal medium may be transmitted using any appropriate medium, including but not limited to wireless, wireline, optical fiber cable, RF, etc., or any suitable combination of the foregoing.

The terms "determine", "calculate" and "compute," and variations thereof, are used interchangeably and include any type of methodology, process, mathematical operation or technique.

"Means" shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

The term "module" refers to any known or later developed hardware, software, firmware, artificial intelligence, fuzzy logic, or combination of hardware and software that is capable of performing the functionality associated with that element.

What is claimed is:

1. An audio amplified combustion system, comprising:

a projection column having an opening at a distal end;

a fuel injector operably connected to a projection volume within the projection column, wherein the fuel injector dispenses fuel within the projection volume;

a projection top positioned over the opening of the projection column, wherein an inner surface of the projection column and an inner surface of the projection top define the projection volume;

at least one escape aperture through the projection top to emit fuel from the projection volume, the at least one escape aperture having an escape area that is between approximately 0.6% and 1.4% of a top surface area of the projection top.

2. The audio amplified combustion system of claim 1, wherein the projection column comprises a material with a column absorptivity, and the projection top comprises a material with a top emissivity, wherein a first coating on the inner surface of the projection column increases absorptivity to greater than the column absorptivity, and a second coating on the inner surface of the projection top reduces emissivity to less than the top emissivity.

3. The audio amplified combustion system of claim 1, further comprising:

a gasket connected to the projection column, wherein a thermal conductivity of the gasket is less than a thermal conductivity of the projection column, and an inner surface of the gasket at least partially defines the projection volume.

4. The audio amplified combustion system of claim 1, further comprising:

a vent column arranged around at least a portion of the projection column to define a vent volume, wherein the vent column has an opening at a distal end; and a fan positioned in the opening at the distal end of the vent column, wherein the fan moves air within the vent volume and induces convective cooling on the projection column.

5. The audio amplified combustion system of claim 1, further comprising an ignition source that ignites fuel emitted from the projection volume.

6. The audio amplified combustion system of claim 1, further comprising:

a control unit operably connected to the fuel injector to control fuel dispensing within the projection volume.

7. The audio amplified combustion system of claim 6, further comprising:

instructions that, when executed by the control unit, cause the control unit to:

determine a frequency range of an audio input;

amplify the frequency range by a predetermined value;

cause the fuel injector to dispense increased fuel.

8. The audio amplified combustion system of claim 1, wherein a ratio between the projection volume and the escape area is greater than 250 inches.

9. The audio amplified combustion system of claim 1, further comprising:

a baseline fuel source operably connected to the projection volume, wherein the baseline fuel source dispenses fuel within the projection volume at a constant rate, and the fuel injector dispenses fuel within the projection volume at a variable rate.

* * * * *